US005263611A

United States Patent [19]

Trippen

[11] Patent Number: 5,263,611

[45] Date of Patent: Nov. 23, 1993

[54] RECEPTACLE TO RECEIVE A FLEXIBLE SUPPLY CONTAINER FOR DISPENSABLE MEDIUM

[75] Inventor: Robert Trippen, Kirchzarten, Fed. Rep. of Germany

[73] Assignee: Innovapack AG, Berwil, Switzerland

[21] Appl. No.: 681,333

[22] Filed: Apr. 5, 1991

[51] Int. Cl.[5] ..... B65D 35/56

[52] U.S. Cl. ..... 222/105; 220/4.24; 220/410; 222/183; 222/325

[58] Field of Search ..... 222/92, 105, 183, 321, 222/325; 220/4.21, 4.24, 410

[56] References Cited

U.S. PATENT DOCUMENTS

| | | | |
|---|---|---|---|
| 2,712,880 | 7/1955 | Moore | 220/4.21 |
| 3,297,206 | 1/1967 | Scholle | 222/105 |
| 3,747,809 | 7/1973 | Harvey et al. | 222/183 |
| 4,413,757 | 11/1983 | Adler | 222/105 |
| 4,892,206 | 1/1990 | Perrin | 215/12.1 |
| 4,974,744 | 12/1990 | Shanklin et al. | 222/183 X |
| 5,004,123 | 4/1991 | Stoody | 222/321 X |

*Primary Examiner*—Andres Kashnikow

*Assistant Examiner*—Joseph A. Kaufman

*Attorney, Agent, or Firm*—Albert H. Reuther

[57] ABSTRACT

A receptacle particularly for a dispenser with a dispenser housing, pump and operating element for receiving a storage supply container having at least one part which is movable into a position making free and accessible an insert opening of the receptacle for installation of a supply storage container which is formed by a flexible bag or pouch-type packing. Two parts moveable as to each other are provided which are separable from each other and which are constructed identically. Those parts have a recess for holding the packing which is provided with a neck. An annular collar is provided for the neck subject to being engaged therebelow by an edge of the recess of the parts. The neck of the packing has an external thread thereon. The two parts are sealingly connectable with each other. The packing also can be provided with a flexible neck provided at a free end thereof with a holder. A receptacle forms an in essence closed housing for the flexible packing which is readily disposable and requires a minimum space for such disposal thereof as waste.

18 Claims, 5 Drawing Sheets

RECEPTACLE TO RECEIVE A FLEXIBLE SUPPLY CONTAINER FOR DISPENSABLE MEDIUM

BACKGROUND OF THE INVENTION

1. Field of the Invention

The present invention relates to a receptacle, especially for a dispenser including a dispenser housing, pump and operating service element, for receiving of a storage supply depository container.

Dispensers are employed and utilized during hand cleansing, skin care and disinfection. Such dispensers are widespread and are mostly employed exclusively in clinics. The soap- or hand creams are liquid or cream-formed soap solutions, predominantly however, soap-free synthetic washing creams. The known dispensers are so constructed that contact-free withdrawal of soap or disinfection medium is possible. Hereby the particular respective medium free of contact sprays upon the hand. The operation occurs via a lever projecting relatively far beyond the housing, which lever can be operated with an underarm or elbow.

The respective medium is kept ready in non-returnable one-way disposable bottles or fill-up replentishable bottles which are arranged in the dispenser housing. The pump consisting of metal is actuated by an operational lever, whereby the medium is pumped out via a sectioned pipe or tube projecting into the bottle. The medium then discharges via an outlet or discharge spout or nozzle projecting outwardly over the housing, which is connected or plugged upon a nozzle or outlet of the pump.

A great problem of disposal or removal exists with utilization and employment of storage supply bottles. The storage supply bottles are unwieldy, cumbersome, bulky, awkward and unmanageable, and also require considerable space needed for such storage supply bottles. Any reusing of such storage supply bottles is eliminated and precluded because of the high cleaning costs connected therewith. Also a reprocessing of the synthetic material of the storage supply bottles is practically not possible.

SUMMARY OF THE INVENTION

An object of the present invention basically is to embody the genus type of container or receptacle means in such a manner that it can be provided with a storage receptacle that is not accompanied by any problems with respect to disposal or elimination thereof.

This object is resolved and fulfilled via a receptacle having at least one portion thereof which for insertion or installation of the storage supply receptacle is movable into a position releasing or making free an insertion opening of the receptacle, and furthermore that the storage supply receptacle is embodied and constructed via a flexible, resilient bag or pouch-type packing.

The flexible, resilient bag or pouch-type packing is capable of being installed and accommodated faultlessly and perfectly satisfactorily in the present inventive receptacle. One receptacle or container part is moved into such a position for installation or insertion of the flexible packing, that the packing can be installed and inserted in the receptacle. Subsequently the container or receptacle part is again moved back into the starting position thereof so that the flexible packing is placed to lie safely and securely in the now closed receptacle. This container or receptacle has an adequate and sufficient self-stability or self-supporting strength so that the receptacle can be handled directly. This receptacle, however, also can be connected or inserted directly in a dispenser in place of previously employed storage bottles therein. The inventive receptacle accordingly with that is employable extensively in many ways. If the packing is empty, then the receptacle is opened and the empty packing is exchanged for a full packing.

Since the packing consists of flexible material, only very minimal space is required. For this reason hundreds of such packings can be bundled into a small package or packet, which accordingly under these circumstances has only a smallest or most nominal space requirement. A comparable quantity of previous or conventional storage supply bottles in comparison would have space requirements greater by a large scale or order of magnitude. Advantageously the entire packing consists of a homogeneous and unitary material, preferably of polyethylene. In this case the used packings can be burned or combusted satisfactorily and completely without residue. With the flexible and resilient packings there is attained approximately 80% to 90% less waste volume than with the previous conventional storage supply bottles. Since the flexible packing consists of a homogeneous unitary material, there is also possible a problemless recycling thereof.

BRIEF DESCRIPTION OF THE DRAWINGS

This object, and other objects and advantages of the present invention, will appear more clearly from the following specification in conjunction with the accompanying drawings.

FIG. 8 is an exploded view illustrating an inventive container or receptacle for receiving a flexible, resilient pouch or bag taking up or receiving a disinfection medium, cleansing medium or care medium and the like;

DESCRIPTION OF PREFERRED EMBODIMENTS

Figure 1:
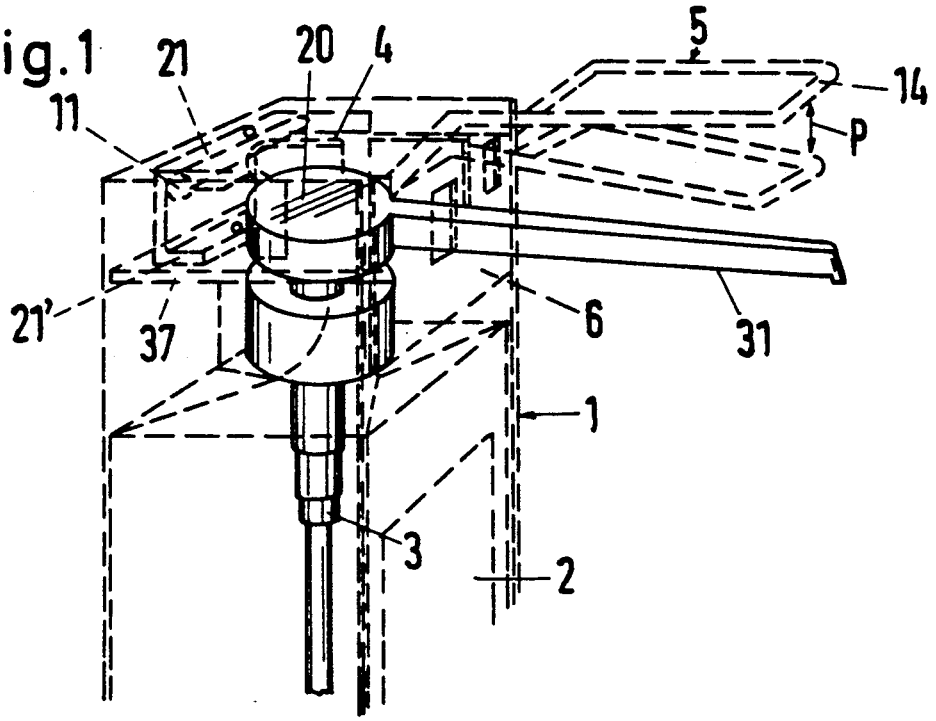
FIG. 1 is a view that shows a portion of a dispenser with a storage supply container and a pump, which is arranged in a holder and is actuatable with an operative serving lever as shown in a perspective fragmentary representation.

Referring now to the drawings, FIGS. 1 through 6 show a dispenser for a soap cream, hand cream, disinfection medium and the like. Such dispensers are utilized and employed preferably in hospitals or in other clinical areas, but also in resturants, offices, laboratories and the like.

The dispensers have a dispenser housing (1), in which a storage supply bottle (2) is arranged with a pump (3). The pump (3) is fastened or secured in a holder (4) and is actuated via an operating lever (5). The storage supply bottle (2) in an upper portion thereof is covered toward the front with a shield plate (6). The shield plate (6) has a smooth front side (7) (FIG. 4), which can be provided with coating inscription applied in a silk-screen method or procedure for identification or mark characterization of the medium such as skin cream or soap cream or disinfection medium located in the storage supply bottle (2).

Figure 2:
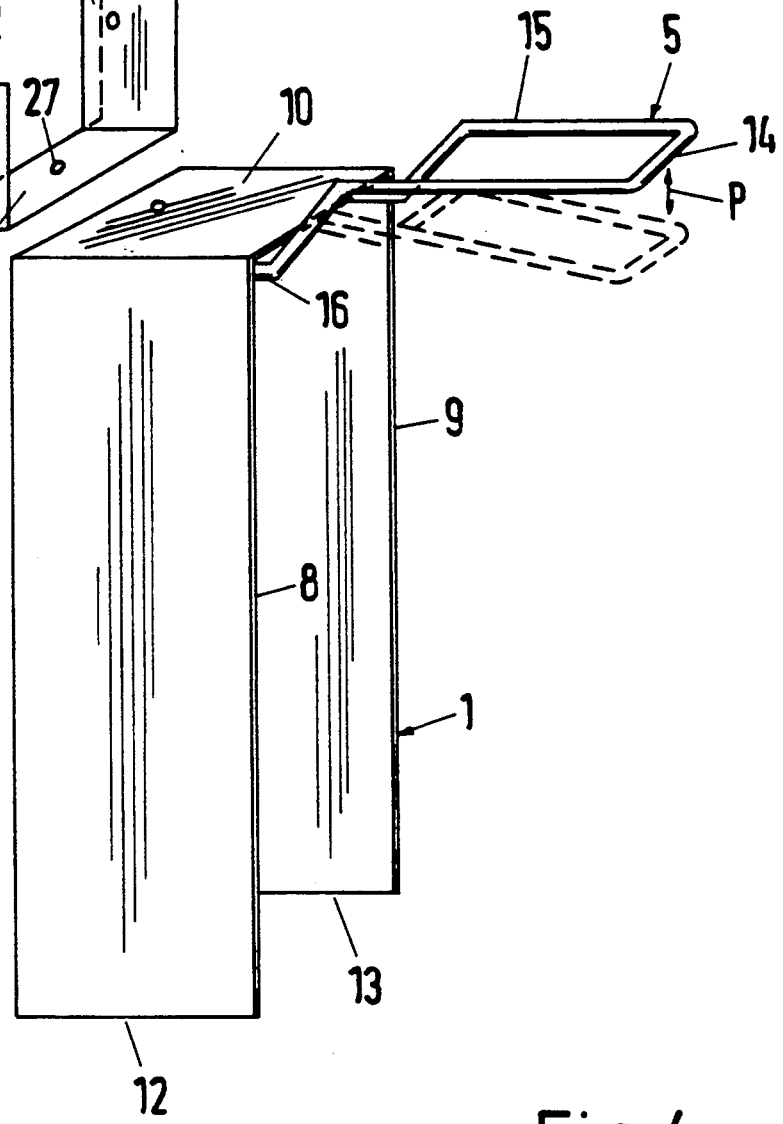
FIG. 2 is a view that shows a dispenser housing with the operational serving lever in a perspective representation thereof.
Figure 3:
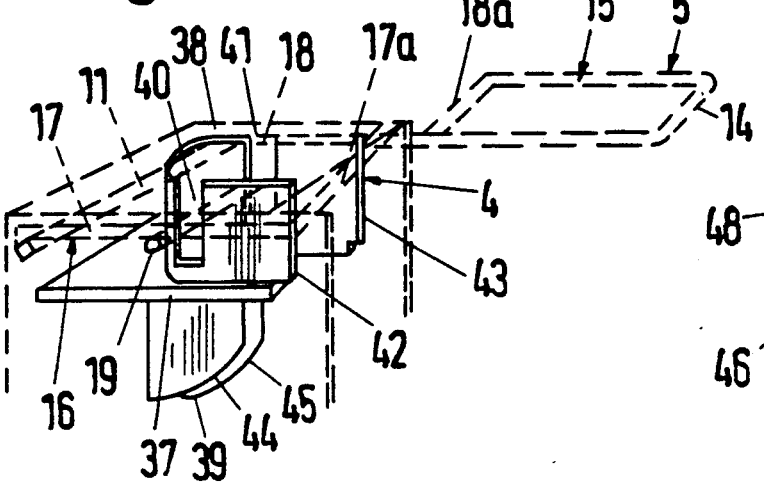
FIG. 3 is a view that shows a portion of the holder of FIG. 1, which is inserted and installed in the schematically indicated dispenser housing with the operative serving lever as illustrated in perspective representation.
Figure 4:
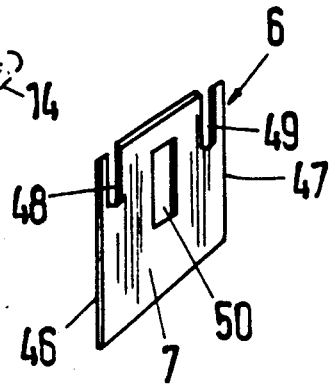
FIG. 4 is a view that shows a shield plate of the dispenser housing according to FIG. 1.

As shown particularly in FIG. 2, the housing (1) has a non-illustrated back or rear wall, over the entire height there extend sidewalls (8, 9) and an upper cover wall (10). As schematically illustrated in FIG. 3, the serving operational lever (5) is journalled with small or nominal spacing below the cover wall (10) with an axis or shaft (11) pivotable on a form part (21) (FIG. 1) preferably consisting of metal, which form part (21) preferably is constructed or made in a U-shaped manner. The form part (21) is not illustrated in FIG. 3 for reasons of facilitating observation and in clear showing of the arrangement illustrated therewith.

The storage supply bottle (2) can be seated or located upon a non-illustrated bar, rod, shaft or the like. The storage supply bottle (2) extends with a small or nominal spacing above the lower edges (12, 13) of the sidewalls (8, 9) and projects with ends thereof into corresponding non-illustrated openings of the sidewalls.

Figure 6:
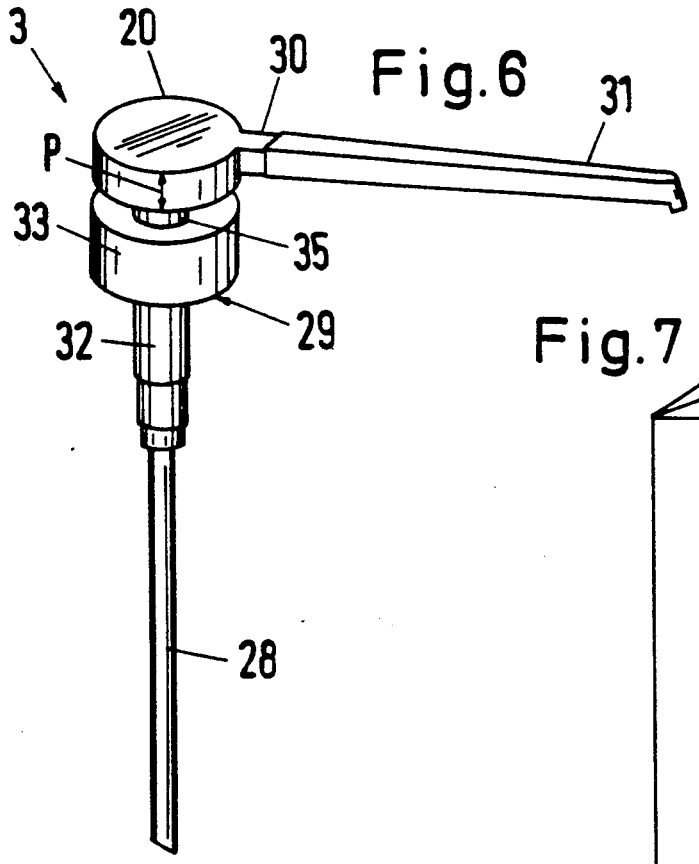
FIG. 6 is a view that shows the pump of FIG. 1 in a perspective illustration.
Figure 7:
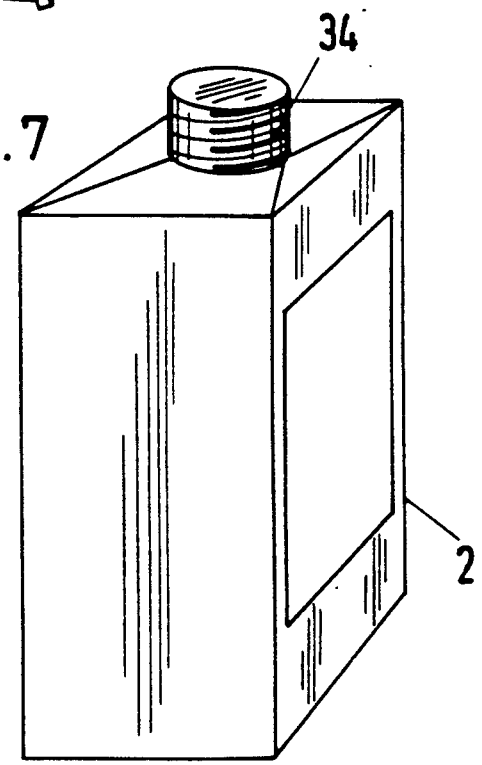
FIG. 7 is a view that shows a storage supply bottle of FIG. 1 in a perspective illustration.

The operational serving lever (5) is constructed bowed handle or strut type of configuration. The lever part (15) providing the transverse web or cross piece (14) of the handle or strut projects toward the front over the housing (1), while the other lever part (16) (FIGS. 2, 3) is accommodated in the housing. The lever parts (15, 16) are offset or displaced as to each other in such a manner that the lever part (15) lies in a plane or level above the cover wall (10), while the lever part (16) extends closely below this wall (10). The lever parts (15, 16) are connected with each other via slanted or oblique shank or side-arm segments or sections (17*a*, 18*a*). A further bar or rod (19) only indicated in FIG. 3 extends between the lever shanks (17, 18) of the lever part (16). The operational serving lever (5) with this further bar or rod (19) engages or lies upon a movable pump part (20) (FIGS. 1 and 6).

Figure 5:
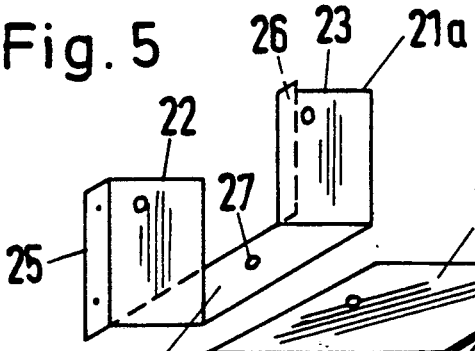
FIG. 5 is a view that shows a perspective representation of a support or holding portion for a dispenser housing of which the rear wall or back consists of synthetic material.

When the back or rear wall of the housing (1) for insulating technical measures or reasons consists of synthetic material, in place of the form part (21) there is employed a holding part respectively holding or support plate (21*a* ) according to FIG. 5 which is screwed on the housing (1). The holding part (21*a*) is constructed or made in a U-shaped manner and has on the shanks (22, 23) thereof outwardly angled-off flanges (25, 26) extending opposite to each other, with which the holding part is screwed engaging against non-illustrated inwardly angled-off or slanted edges of the sidewalls (8, 9). A transverse web or cross piece (24) of the holding part (21*a*) has an opening (27) for a fastening screw with which the support or holder (4) can be releasably fastened on the holding part (21*a*) lying or engaging upon the transverse web or cross piece (24).

The pump (3) is a dispenser means fastened or secured in the holder (4). The pump (3) has a suction pipe or tube (28), a connection piece (29) and a movable part (20) which has a radially projecting outlet connection or strut (30) upon which an extension piece (31) is seated or located.

The connection piece (29) has a pipe or tube segment (32) which has a transition or passes over into an expanded or widened ring or annular collar (33). The annular collar can have an inner thread with which the connection piece (29) can be threaded or screwed upon the outer thread of a narrow neck of a bottle (34) of the storage supply bottle (2).

The movable pump part (20) with a tribular-shaped extension (35) is inserted or connected into an opening of the annular collar (33) oriented or aligned with the opening of the tribular segment (32). The pump part (20) can be pressed downwardly in an arrow direction P counter to the force of a non-illustrated pressure spring until the ring or annular disk shaped pump part (20) comes into engagement against the connection piece (29) of the pump (3). During pressing of the pump part (20), the fluid or liquid is suctioned out of the bottle (2) into the suction pipe or tube (28) and is conveyed upwardly so that the fluid or liquid discharges via the outlet connection or strut (30) and the extension piece (31). The pump (3) fills again during springing back of the pump part (20).

The pressure spring of the pump (3) is so arranged and constructed that this spring moves back into the illustrated starting position after the actuation of the operational serving lever (5) loaded or pressed upon the pump part (20).

The extension piece (31) is so long that it projects over more than three quarters of its length outwardly over the housing (1) and the baffle or shield plate (6). Preferably the operational serving lever (5) projects over the extension piece (31) out of the housing (1). The operational serving lever (5) is thereby easily actuated, especially with an underarm or an elbow of an operator or serving individual. Additionally such person also can conveniently and comfortably hold the hands therebelow for cleaning and disinfection via the foregoing projecting extension piece (31) without thereby contacting or touching the dispenser.

The support or holder (4) consists of a holding plate (37) as well as upper and lower holding parts (38) and (39) which extend or project upwardly respectively downwardly from the holding plate (37). The holding plate (37) can be constructed unitary or integral with the holding parts (38, 39), but also can be connected for example by being welded therewith. The holding part (37) engages against a lower horizontal shank (21') of the form part (21) (FIG. 1), and is secured or fastened releasably thereon preferably with at least one screw. If the holding part (21*a*) is employed, then the holding plate (37) engages against the transverse web or cross piece (24) and is releasably connected therewith via a fastening screw which is screwed into the opening (27).

The two holding parts (38) and (39) are constructed respectively partially cylindrical in configuration and in an inner diameter thereof being matched or adapted to the outer diameter of the pump part (20) and of the connection piece (29) of the pump (3). Thereby the lower holding part (39) accordingly is so constructed and arranged that the connection piece (29) respectively the ring or annular collar (33) lies with a clamping in the holding part (39), while the pump part (20) is arranged with a small or nominal play in the holding part (38). The pump (3) is held in the support or holder (4) via a clamping seat or tight fit in the holding parts (39).

The upper holding part (38) has an axially extending upwardly opened slit or slot means (40, 41) oriented or aligned with each other transverse thereto, through which the ends of the rod or bar (19) of the operational serving lever (5) project. The holder (4) and the operating lever (5) can be so constructed and arranged that the rod or bar of the operating serving lever (5) during swinging or pivoting abuts or strikes against the slot end and thus the pivot path of the operating lever is limited or restricted. Consequently the stroke respectively pump path is limited or restricted in a simple and straight forward manner. This stroke or pump path can be so limited or restricted that during pressing down of the operating lever (5), for example, 1.5 milliliter medium is pumped out from the bottle (2). For stroke adjustment, for example, an abutment can be provided, applied or installed adjoining the holding parts (38) upon the holding plate (37), which abutment or stop is adjustable to different levels or heights and lies in the pivot path of the operating lever (5).

The lower holding part (39) has a partially circular shaped rounded-off front edge means (44, 45) (FIG. 3) so that the pump (3) is easily installable from below into the holder (4).

The axes of the holding parts (38, 39) oriented or aligned approximately with each other fall or coincide approximately with the longitudinal center axis of the housing (1).

The baffle or shield plate (6) adjacent to edges (46, 47) thereof has two upwardly opened slots (48, 49), through which the shank segments (17*a*, 18*a*) of the operating lever (5) project. The baffle or shield plate (6) between the slots (48, 49) has a preferably rectangular shaped opening (50) that extends parallel to the slots (48, 49), although being displaced or offset somewhat downwardly relative thereto. The extension piece (31) of the pump (3) projects outwardly through this opening (50). The slots (48) and (49) and the opening (50) are respectively so long that they do not restrict or hinder the up and down movement of the operating lever (5) respectively of the movable pump part (20) with the outlet extension piece (31).

The baffle or shield plate (6) can be held on the holder (4) or on the sidewalls (8, 9) of the housing (1) with a non-illustrated snap-closure or snap-catch. For this purpose the baffle or shield plate (6) with the edges (46, 47) thereof can be snapped into the pertaining edge-open depressions or recesses of the holder (4) respectively of the upper holding part (38) thereof or the sidewalls (8, 9). The baffle or shield plate (6), however, also can be releasably secured or fastened via a latch connection or arresting connection and are capable of being released simply in a different manner and without great force being needed to be applied.

When in place of the screw connection between the storage supply bottle (2) and the ring or annular collar part (33) of the pump (3) there is provided a plug connection or the diameter of the inner thread of the ring collar part is greater than that of the thread of the narrow neck (34) of the bottle, a bottle (2) can be withdrawn downwardly for interchanging thereof, whereby the bottle neck (34) is withdrawn from the ring or annular collar (33) of the pump (3). Thereby the pump (3) remains fastened or secured with the suction pipe or tube (28) thereof on the holder (4). The bottle (2) accordingly can be interchanged simply with only one hand for a new, full bottle.

If also the pump (3) is to be removed from the dispenser housing (1), then first the storage supply bottle (2) must be removed or taken out and then the operating lever (5) must be pressed downwardly in the direction of an arrow P. Thereby the pump (3) is pressed downwardly out of the holder (4).

As a protection against theft and operational failure there can be provided a latching respectively securing means against theft. This latching or securing means against theft, for example, is applied or installed on the baffle or shield plate (6) and projects so far into the holding part (39) that the connection piece (29) of the pump (3) first can be pressed out when the baffle or shield plate (6) is removed.

When the inner thread of the ring or annular collar part (33) of the pump (3) is constructed fitting as to the bottle neck thread, the storage supply pump (2) and the pump (3) are removed in common or together for bottle change. Subsequently thereafter the pump (3) is unscrewed from the bottle (2) and then is screwed upon a new bottle and both parts together are installed or inserted from below into the dispenser housing (1).

So that the pump (3) can be delivered in a hygienically faultless or impeccable condition, provision is made that a protective sleeve or hull is placed or inserted upon the suction tube (28). For insertion or installation of the pump (3) into the supply storage container (2), the pump (3) can be secured or accommodated on the protective sleeve or hull and the protective sleeve or hull can then be withdrawn or pulled off after the installation or inserting procedure has occurred.

The pump (3) which is embodied and constructed as a disposable or throw-away part, is regularly interchanged for a new pump. Thereby the closure part, the valve spheres or balls, pressure springs and the discharge or outlet part are regularly renewed. Accordingly there is eliminated the servicing, maintenance, unclamping and renewing of closure parts necessary with known dispensers, whereby the material costs connected herewith and the working complexity and costs involved herewith can be eliminated. Since the pump (3) with the holder (4) can be held or kept still independently of the container or bottle (2) in the dispenser housing (1), conventional or formal housing, operating lever and the like usual for the dispenser can be kept and maintained so that the described dispenser has substantially the familiar or accustomed optical appearance. Also, conventional or usual soap dispensers can be converted in a simple and straight forward manner, respectively can be equipped with the holder for the pump (3). Via the unchanged appearance the same then also optically match the most eventually unchanged disinfection dispensers and skin cream dispensers hanging adjacent thereto.

Conventional or usual dispenser housings can be employed for new dispensers or can be built in a similar manner, whereby the holder (4) and the baffle or shield plate (6) can be installed or built-in therewith. The dispenser housing (1), however, can also be conceived and constructed in a completely new and novel manner whereby the pump stroke can be attained not only by the conventional pump pressure downwardly, in the sample embodiment by engagement of the pump part (20) against the holding plate (37) of the holder (4), but rather also can be attained selectively by selective lifting or pulling up of the bottle.

If the holding part (21*a*) according to FIG. 5 is installed in the housing (1), then the shaft or axis (11) of the operating lever (5) is journalled in the shanks (22, 23).

Figure 8:
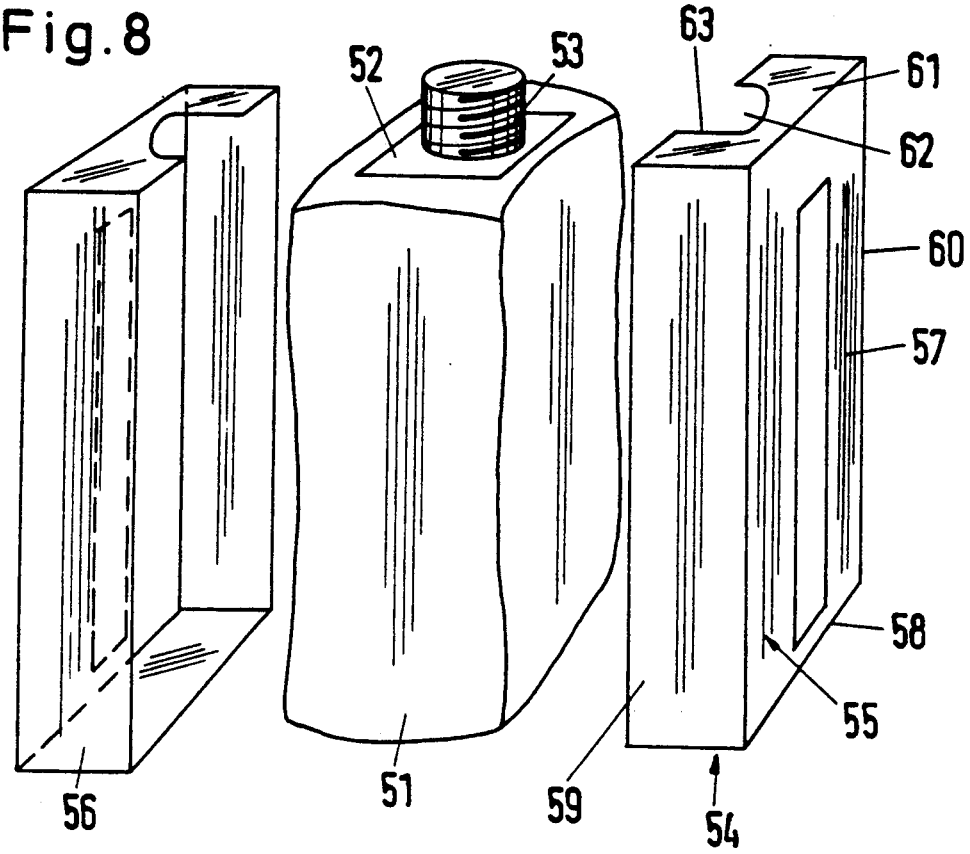

With utilization of these described storage supply bottles (2) for the different mediums there exists the great problem of disposal or removal and elimination thereof. The storage supply bottles (2) are bulky and require considerable space. A repeated use or reutilization is precluded because of the high cleaning costs connected therewith. Also a reprocessing of the synthetic material of the storage supply bottle is practically not possible. Inventively, provision is now made that respectively particular mediums would not be accommodated in a bottle but rather would be accommodated and received in a flexible packing (51) (FIG. 8). This packing (51) consists of a thin, tear-resistent synthetic material, for example thermal plastic material such as polyethylene. This flexible packing which is constructed in the manner of a bag or pouch is provided with a strengthened or reinforced synthetic material plate (52) which carries a neck (53) therewith. The synthetic material plate (52), moreover, is somewhat stiffer than the packing (51) itself, although always still being constructed in a flexible and resilient manner. The packing (51) can be filled with thin- or thick liquid or powder-formed or granulated media.

The packing (51) is inserted or installed in a container or receptacle (54), which in the sample embodiment consists of two halves (55) and (56). These halves (55) and (56) are identically constructed and are arranged in a mirror-symmetrical relationship to each other. For this reason in the following description only one half (55) is described more closely and in further detail. This half (55) has a back or rear wall (57), a bottom (58), sidewalls (59, 60) and a cover or top wall (61). In the cover or top wall (61) there is provided a semi-circular-shaped recess (62), into which the neck (53) of the packing (51) projects in the installed or inserted position. The two halves (55) and (56) are so arranged or placed against each other that with the sidewalls, the bottom thereof and the top or cover wall abut against each other and in this manner form the container or receptacle (54) which is closed on all sides. The two semi-circular-shaped recesses (62) then provide or result in a circular-shaped through-passage opening for the neck (53) of the packing (51). Preferably the two halves (55) and (56) are constructed overlapping at the edges thereof abutting against each other so that a type of seal is formed thereby, thus to prevent or preclude any escape or discharge of the medium from the container or receptacle (54) upon accidental or inadvertent tearing-open of the packing (51). One or more seals also can be inserted or placed in the edges or impact edges in order to keep and maintain the container or receptacle (54) absolutely tightly sealed in spite of a two-part construction and arrangement thereof.

Figure 9:
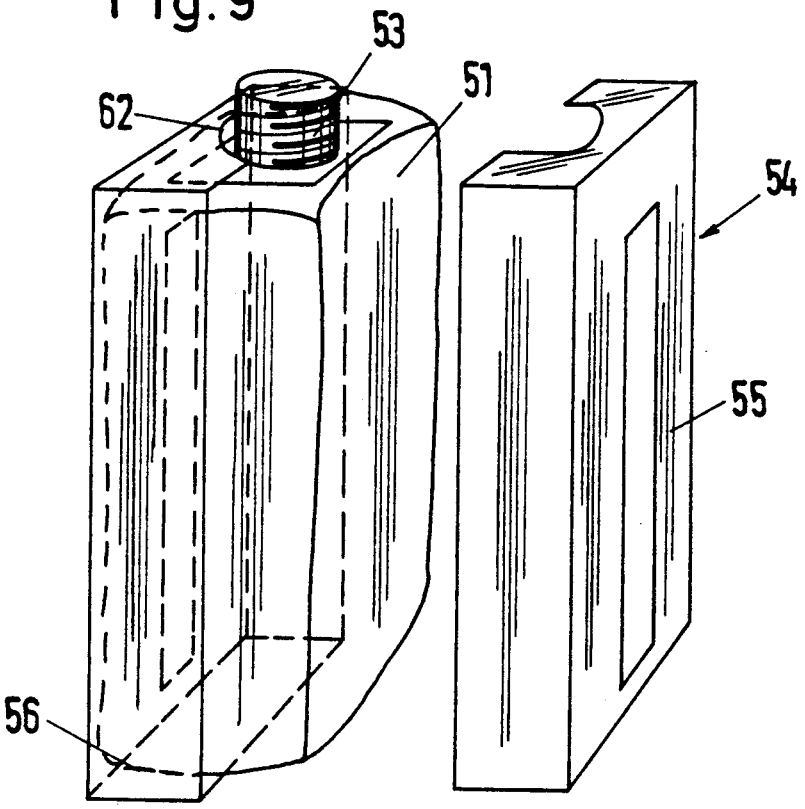
FIG. 9 is a view that shows the bag or pouch of FIG. 8 which is inserted and installed in a container or receptacle portion.

FIG. 9 shows and illustrates a possibility to install or accommodate the packing (51) in the container or receptacle (54) in the most simple and straight forward manner as possible. Purposefully the packing (51) for this purpose first is inserted or installed in one half (56) of the container or receptacle (54) in such a manner that the neck (53) projects into the recess (62) of the half (56). Since the packing (51) hereby is already partially surrounded by the sidewalls, the top or cover wall and the rear or back wall and the bottom of the half (56), subsequently the other half (55) can be easily placed and installed without damaging the packing (51). The two container or receptacle halves (55) and (56) are advantageously provided with latching or securing devices with which the two halves (55) and (56) are reliably held together. In order to attain a faultless and impeccable holding of the packing (51) satisfactorily in the container or receptacle (54), the neck (53) preferably is provided with a non-illustrated surrounding collar, which is provided with a small or nominal spacing above the synthetic material plate (52). The container or receptacle halves (55) and (56) then engage with the edge (63) thereof (FIG. 8) delimiting or restricting the recess (62) below or under this ring or annular collar so that the packing (51) no longer can be shifted in axial direction of the holder (53) with respect to the container or receptacle (54).

The described container or receptacle (54) can be installed and inserted in place of the housing (1), respectively bottle (2), according to the FIGS. 1 through 7 inclusive. In this case, the container or receptacle (54) likewise forms a dispenser housing. Additionally moreover the special advantage of this receptacle or container (54) exists therein that it also can be used separately which means independently of a dispenser. Thus, the container or receptacle (54) can be installed and employed in a household, for example, with the inserted flexible, resilient bag or pouch-shaped packing (51). The packing (51) can be provided or equipped with a dispenser, a spray closure, a spray pistol, a dosing means, a spray head or the like. In the packing (51) there can be provided hand-cleansing and body-cleansing means or media, skin- and care media, disinfection means or media of every type for hands, surfaces, instruments and the like as well as scenting materials, cosmetic preparations and the like.

If the container or receptacle (54) is employed as a separate container, which is useable and employable independently of a dispenser, then this container can have every adaptable suitable outline shape. Basically the container or receptacle (54) also can have every desired formation also during employment as a dispenser housing.

If the packing is empty, then the container or receptacle (54) is opened and the empty packing (51) is interchanged for a full packing (51) as to the container or receptacle (54). Since the packing consists of foil-type flexible material, the packing (51) only requires very small or nominal space. For this reason hundreds of such packings can be bundled into a small package or packet which accordingly only has the smallest or most nominal space requirement. A comparable quantity of previous or conventional storage supply bottles would in comparison have a greater space requirement by a larger scale or order of magnitude.

The neck (53) of the packing (51), as illustrated in FIGS. 8 and 9, can be provided with an outer thread means so that a screw closure can be applied or installed upon the neck.

Figure 10:
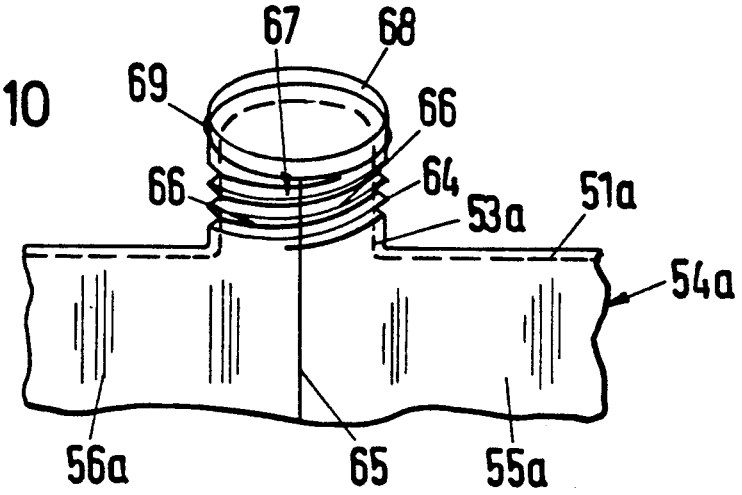
FIG. 10 is a view that shows a simplified illustration of a further embodiment of an inventive receptacle or container.

FIG. 10 shows the possibility of also providing the outer thread means (64) on the container or receptacle (54*a*). This container or receptacle (54*a*) likewise consists of the two halves (55*a*, 56*a*) which are joined or brought together as described into the container or receptacle (54*a*). The abutment or impact location is designated with the reference numeral (65). The two halves (55*a*, 56*a*) have a partially cylindrical extension (66) which in the joined condition forms a neck (67) with the outer thread means (64). The packing (51*a*), which is indicated with dash lines in FIG. 10 in this situation can consist generally as a rule all the way of foil-type, flexible or resilient material. Accordingly also the neck (53*a*) of the packing (51*a*) is formed or made of this material. In order to prevent slipping or sliding of the neck (54*a*) of the packing (51*a*) through the neck (67) of the container or receptacle (54*a*), the neck (53*a*) at a free end is provided with a surrounding, bead-type thickening (68) which engages upon the end or face side (69) of the neck (67) of the container or receptacle (54*a*). The thickening or bead (68) is so stiff that it cannot slide or slip through the neck (67) into the container or receptacle (54*a*). Preferably a bead thickening or enlargement (68) can serve as a seal, when for example a spray head is screwed upon the neck (67) of the container or receptacle (54*a*).

The opening of the packing (51*a*) surrounded by the bead thickening (68) is first closed with a foil-type cover or lid, which can be withdrawn or pulled away after insertion or installation of the packing (51*a*) in the container or receptacle (54*a*).

Figure 11:
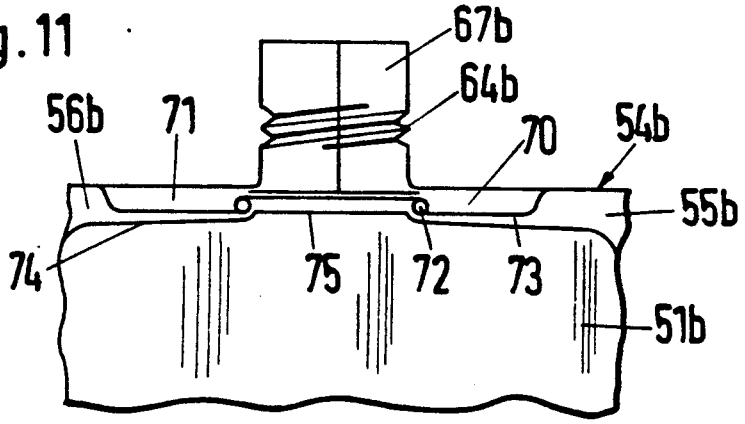
FIG. 11 is a view that illustrates the further embodiment of the inventive receptacle corresponding to FIG. 10.

A further possibility in the construction or embodiment of the receptacle or container and the packing is shown by FIG. 11. The container or receptacle (54*b*) on the other hand has a neck (67*b*) and is formed of the two halves (55*b*) and (56*b*). The two halves (55*b*) and (56*b*) on an inner side thereof respectively are provided with a receiving means (70) and (71), which is constructed as a surrounding or all-around pocket and receiving a bead-type annular or ring-shaped thickening (72) of the packing (51*b*). The two receiving means (70, 71) are delimited or bounded respectively by a disk or plate part (73) and (74), which is fastened on an inner side of the two halves (55*b*, 56*b*). The disk parts (73, 74) delimit or bound an opening (75) in the joined or assembled position, which opening (75) is oriented in alignment with the neck (67*b*) of the container or receptacle (54*b*), and through which the packing (51*b*) projects. The neck (67*b*) on the other hand can be provided with an external thread means (64*b*).

Figure 12:
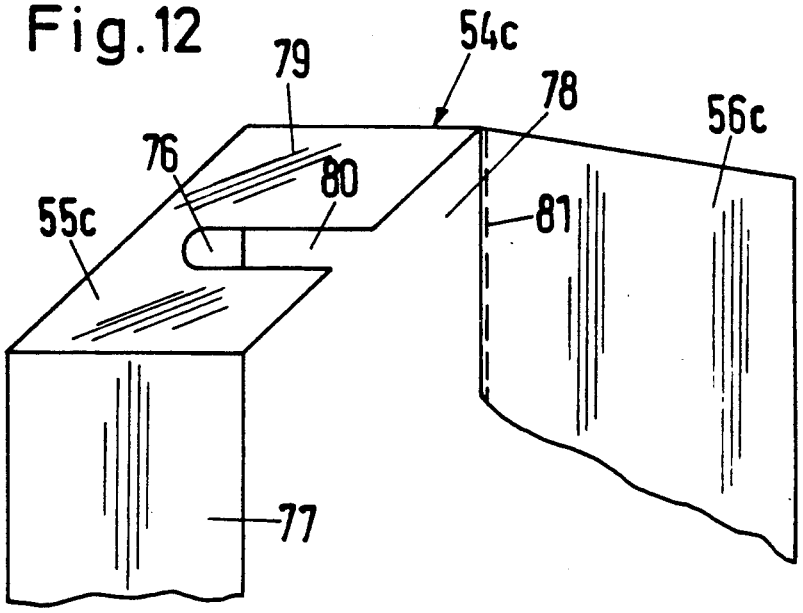
FIG. 12 is a view that shows a perspective illustration of a portion of a further embodiment of an inventive receptacle or container.

While with the previously described embodiments according to FIGS. 8 through 11 inclusive the container or recptacle respectively is formed by two halves completely separate from each other, FIG. 12 shows an embodiment with which the container or receptacle consists of two parts which, however, are articulately or hingedly connected with each other. The container or receptacle (54*c*) in this situation has a first container or receptacle part (55*c*) which has a rear wall (76), sidewall (77) and (78), a non-illustrated bottom as well as a top or cover wall (79). It is on the other hand provided with a recess (80) which receives or takes up the neck of the packing in the described manner. The recess (80) is so long that the packing can be installed or accommodated completely within the container or receptacle part (55*c*). The other container or receptacle part (56*c*) forms a back or rear wall of the container or receptacle (54*c*), which is linked or pivotally connected to the container or receptacle part (55*c*) longitudinally of an edge (81) of the sidewall (78). The container or receptacle part (56*c*) can be swung or pivoted out of the illustrated open position into the closure position in which the container or receptacle part (55*c*) closes on a rear or back side thereof. The container or receptacle part (56*c*) is secured in a suitable manner in the closure position on the container or receptacle part (55*c*).

The container or receptacle part (56*c*) also can be linked or connected to the other sidewall (77), on the bottom or on the top or cover wall (79) of the container or receptacle part (55*c*). This embodiment has the advantage that the packing first can be accommodated completely in the container or receptacle part (55*c*) so that subsequently the container or receptacle part (56*c*) only needs to be swung or pivoted into the closure position. Hereby there does not exist the danger that the container or receptacle part (56*c*) due to wrong attachment or connection inadvertently or accidentally damages the packing (51).

Figure 13:
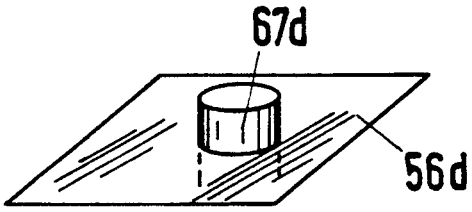
FIG. 13 is a view that shows in a perspective and exploded illustration a further embodiment of an inventive receptacle or container.
Figure 13:
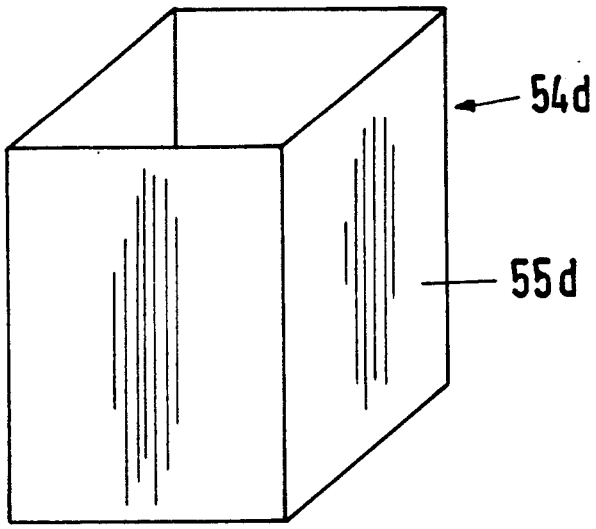

With the embodiment according to FIG. 13 finally, the container or receptacle part (55*d*) likewise is constructed as a substantially closed container or receptacle. The other container or receptacle part (56*d*) can be removed completely from the container or receptacle part (55*d*). The packing can be installed and inserted in a simple and straight forward manner thereby into the upwardly open container or receptacle (54*d*). Subsequently a container or receptacle part (56*d*) forming a cover is placed or installed upon the container or receptacle part (55*d*). The container or receptacle part (56*d*) again on the other hand can provide a neck (67*d*) which also can be provided and equipped with an outer thread. The packing is then held in the same manner in the container or receptacle (54*d*) as set forth and explained in the preceding sample embodiments.

Situations are also conceivable with which the foil-type material of the packing has a predetermined or certain self stiffness or rigidity of its own. In such situations, according to the embodiment of FIG. 12, then the container or receptacle part (56*c*) would not be necessary or required. In this situation, it is completely adequate and sufficient to insert or install the packing in a container or receptacle part (55*c*).

The described containers or receptacles are adapted and suitable not only for the dispenser according to FIGS. 1 through 7 inclusive, but rather also for conventional or previously known usual dispensers. Additionally, the described containers or receptacles are also installed or employed as separate containers, which are employed only for receiving and holding of the packing provided with the particular respective media. If the containers or receptacles are formed of two parts separate from each other (FIGS. 8 through 11 and 13), then the one container or receptacle part, for example, also can be secured or fastened to one wall so that after the installation or insertion of the particular or respective packing then the other container or receptacle part can be applied or installed as to this preassembled container or receptacle part. It is furthermore possible to provide on one wall or the like a holding device, in which the described containers or receptacles can be hung or suspended therein. Such a variation has the advantage that the container or receptacle can be removed and can be cleaned in a simple and straight forward manner.

There exists the possibility that the container or receptacle, which is equipped or provided for example with a dispenser, can be releasably secured or fastened with the packing located therein, for example, on a sidewall of a cleaning bucket. Then for example a disinfection means or medium can be introduced directly into the liquid located in the cleaning bucket. Such a cleaning bucket with a container or receptacle hung or suspended therein could also simultaneously serve as a shipment container.

The sample embodiment or arrangements described with respect to FIGS. 8 through 13 have in common that flexible packings can be employed and utilized which do not bring therewith or are not accompanied by any waste problems. The empty packings can be folded together very small respectively can be bundled so that also with a large number or packings only very little space is required for this waste material. This is an advantage not to be underestimated especially for hospitals in which regularly large or great quantities of packings are consumed and utilized. Moreover, also with the sample embodiments according to FIGS. 8 through 11 and 13 there is noted that the container or receptacle parts can be connected, articulated or pivotally linked with each other.

The containers or receptacles of the described embodiments also can be so constructed and configured that the container or receptacle parts are constructed and made unitary and integral with each other and, for example, via a cross sectional weakening or thinning there is formed a link or hinge arrangement between the container or receptacle parts. Also in this situation in spite of the unitary or integral construction of the container or receptacle there can be assured and obtained the described functional manner. The container or receptacle parts as a consequence of the articulated or linkage-type cross sectional weakening or thinning of the structure can be pivoted as to each other in order to insert or install the packing into the container or receptacle in order to remove the same therefrom.

In summary, the present inventive disclosure provides a container or receptacle, especially for a dispenser with a dispenser housing, pump and operating element for receiving a storage supply container, characterized thereby that the receptacle (54, 54*a*) through (54*d*) has at least one part (55, 55*a*) through (55*d*); (56, 56*a*) through (56*d*), which for insertion or installation of a storage supply container or receptacle (51, 51*a*, 51*b*) is moveable into a position making free and accessable an installation opening of the receptacle, and that the storage supply container or receptacle (51, 51*a*, 51*b*) is formed by a flexible, resilient bag or pouch-type packing.

The foregoing receptacle has two parts (55, 55*a*) through (55*d*); (56, 56*a*) through (56*d*) moveable relative to each other. The two parts (55, 55*a*, 55*b*, 55*d*; 56, 56*a*, 56*b*, 56*d*) are separable from each other. The two parts (55, 55*a*, 55*b*; 56, 56*a*, 56*b*) are constructed and embodied identically. The two parts (55, 56) respectively provide and have a recess (62) for holding of the packing (51).

The packing (51) is provided with a neck (53). The neck (53) is provided with a ring or collar means which is engaged underneath by an edge (63) of the recess means (62) of the parts (55, 56). The neck (53) of the packing (51) has outer thread means thereon.

The two parts (55, 55*a*, 55*b*, 55*d*; 56, 56*a*, 56*b*, 56*d*) are sealingly connectable with each other. The two parts (55, 55*a*, 55*b*; 56*a*, 56*b*) of the container or receptacle (55*a*, 55*b*) respectively have and are provided with an extension (66) for formation of a neck (67, 67*b*) which preferably is provided with an outer thread means (64, 64*b*).

The packing (51*a*) provides and has a flexible neck (53*a*), which at a free end thereof is provided with a support or holding means (68).

The packing (51*b*) is provided with a support or holder (72) which lies in a receptacle or receiving means (70, 71) of the container or receptacle (54*b*). A receiving means (70, 71) is delimited and bounded by a disk part (73, 74) which is fastened on the inner side of each part (55*a*, 55*b*, 56*b*) of the container or receptacle (54*b*).

One part (55, 56*c*) of the container or receptacle (54, 54*c*) is linked or articulately joined to the other part (56, 55*c*) respectively.

One part (56*c*, 56*d*) forms a wall of the container or receptacle (54, 54*d*).

The container or receptacle (54, 54*a*) through (54*d*) forms in essence a closed housing for the flexible packing (51, 51*a*, 51*b*).

The present invention is, of course, in no way restricted to the specific disclosure of the specification and drawing(s), but also encompasses any modifications within the scope of the appended claims.

What I claim is:

1. A receptacle having a dispenser housing to receive a flexible storage supply container for dispensable medium, comprising:

receptacle means having at least two joinable parts at least one of which is moveable into a position making free and accessible an installation opening of the receptacle for insertion of the supply storage container therein with one part forming a wall of the housing, said supply storage container being formed by a flexible, bag pouch-type packing;

said receptacle means being composed of said at least two parts of which one part is moveable into a position exposing the installation opening for installation of the supply storage container, said receptacle means being provided with a neck means having an external threaded portion, said neck means surrounding a flexible neck of said supply container provided with a thickened portion and upon which neck means of said receptacle means a screw part is screwable, said parts thereof in a closure position being held sealingly directly against each other, said thickened portion of said neck of said supply container integrally therewith being a ring-shaped annular bead collar which in a region of said neck means engages upon a countersupport of said receptacle means.

2. A receptacle according to claim 1, in which two parts are provided moveable with respect to each other.

3. A receptacle according to claim 2, in which said two parts are separable from each other.

4. A receptacle according to claim 2, in which the two parts are identical in configuration thereof.

5. A receptacle according to claim 2, in which the two parts respectively have a recess for holding of said packing.

6. A receptacle according to claim 1, in which said packing is provided with a neck.

7. A receptacle according to claim 6, in which said neck is provided with an annular collar and an edge of the recess of the parts engages and fits underneath said collar.

8. A receptacle according to claim 6, in which said neck of said packing has an outer thread means.

9. A receptacle according to claim 2, in which the two parts are sealingly connectable with each other.

10. A receptacle according to claim 2, in which the two parts of the receptacle respectively have an extension for formation of a neck.

11. A receptacle according to claim 1, in which said packing has a flexible neck which is provided with a holding means at a free end thereof.

12. A receptacle according to claim 1, in which said packing is provided with a holding means which lies in a receiving means of said receptacle.

13. A receptacle according to claim 12, in which the receiving means is bounded and delimited by a disk part, which is fastened on an inner side of each part of the receptacle.

14. A receptacle according to claim 2, in which one part of the receptacle is articulated and linked to the other part.

15. A receptacle according to claim 1, in which one of two receptacle parts forms a wall of the receptacle.

16. A receptacle according to claim 1, in which the receptacle forms a closed housing for the flexible packing.

17. A receptacle according to claim 3, in which the two parts are identical in structure.

18. A receptacle according to claim 10, in which said neck is provided with an outer thread means.

* * * * *